US008168006B2

(12) United States Patent
Bengston et al.

(10) Patent No.: US 8,168,006 B2
(45) Date of Patent: May 1, 2012

(54) UTENSIL HOLDER ASSEMBLY FOR A DISHWASHER

(75) Inventors: Debra L. Bengston, Jackson, TN (US); Mark Britton, Portland, OR (US); Heather Hagans, Jackson, TN (US); Scott D. Raches, Jackson, TN (US); Wayne M. VanLandingham, Texarkana, TX (US); Christopher W. Vaughn, Mebane, NC (US); Karl R. C. Wendt, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1894 days.

(21) Appl. No.: 11/114,177

(22) Filed: Apr. 26, 2005

(65) Prior Publication Data

US 2006/0237051 A1 Oct. 26, 2006

(51) Int. Cl.
*B08B 3/00* (2006.01)

(52) U.S. Cl. ..... 134/56 D; 134/57 D; 134/58 D; 134/92; 134/135

(58) Field of Classification Search ..... 134/25.2, 134/25.4, 52, 57 D, 57 DL, 56 D, 58 D, 58 DL, 134/92, 135

See application file for complete search history.

(56) References Cited

U.S. PATENT DOCUMENTS

| | | | | |
|---|---|---|---|---|
| 3,665,943 | A * | 5/1972 | Lampman et al. | 134/200 |
| 3,732,876 | A | 5/1973 | Braga et al. | |
| 4,834,125 | A | 5/1989 | Insalaco | |
| 5,069,360 | A | 12/1991 | Dingler et al. | |
| 5,431,294 | A * | 7/1995 | Stottmann et al. | 220/23.4 |
| 5,882,739 | A * | 3/1999 | Kobos et al. | 427/536 |
| 6,161,718 | A | 12/2000 | Monbo | |
| D487,825 | S | 3/2004 | Kim et al. | |
| D502,295 | S | 2/2005 | Feddema | |
| 2002/0139809 | A1 * | 10/2002 | Barry et al. | 220/762 |
| 2004/0094555 | A1 | 5/2004 | Raches et al. | |
| 2005/0045215 | A1 * | 3/2005 | Raches et al. | 134/135 |

FOREIGN PATENT DOCUMENTS

| | | |
|---|---|---|
| EP | 0 697 187 A1 | 2/1996 |
| JP | 406100041 | 4/1994 |

* cited by examiner

*Primary Examiner* — Michael Barr
*Assistant Examiner* — Benjamin Osterhout
(74) *Attorney, Agent, or Firm* — Robert A. Bacon; Diederiks & Whitelaw PLC

(57) ABSTRACT

A utensil holder assembly for a dishwasher includes multiple utensil baskets that can be mounted in various different configurations in the dishwasher to provide a consumer with the flexibility to construct diverse arrangements of dishware, cookware, utensils and the like for a washing operation. In a first configuration, two utensil baskets are interconnected to form an elongated basket which can be mounted to an inner liner of a dishwasher door. In a second configuration, one basket is mounted to the inner liner and the other basket is supported on a rack in the dishwasher. In a third configuration, both of the baskets are supported on the rack.

17 Claims, 6 Drawing Sheets

UTENSIL HOLDER ASSEMBLY FOR A DISHWASHER

BACKGROUND OF THE INVENTION

1. Field of the Invention

The present invention pertains to the art of dishwashers and, more particularly, to a utensil holder assembly including multiple utensil baskets that can be joined to mount on a door of a dishwasher or separated to mount on the door and/or a rack of the dishwasher.

2. Discussion of the Prior Art

In general, dishwashers are designed to wash/sanitize dishware, cookware and utensils used in the preparation and consumption of food. Toward that end, a typical dishwasher includes a wash chamber, a pump assembly for generating a washing fluid flow in the wash chamber and at least one rack for supporting articles to be cleaned. The dishwasher also includes a door that seals across the wash chamber to prevent washing fluid from escaping during a wash operation. In most cases, the door will have an outer decorative shell designed to blend in with surrounding cabinetry and an inner liner which carries detergent and water conditioning dispensers. Typically, items such as dishware, bakeware, glassware and the like are supported on the rack(s) during the washing operation, while smaller items such as silverware and utensils are placed in a basket for washing.

In most cases, the basket is supported on a lower rack of the dishwasher. Silverware and other utensils placed in the basket are exposed to a spray of washing fluid during the washing operation. Some baskets are fixedly mounted to racks, while others are removable so as to allow positioning in various locations in the dishwasher, as well as facilitate the unloading of utensils. In this manner, the basket can be placed in a location to allow for specific placement of dishware, or removed all together to accommodate larger items such as bowls and baking dishes. However, while larger items or loads can be washed by removing the basket, a separate cycle will then be required to wash the utensils or larger items, or these items will need to be washed by hand.

As an alternative to baskets supported by or affixed to the rack, some dishwashers mount the utensil baskets to inner liners of doors. The baskets can either be formed as part of the inner liner, or designed to be removed to facilitate unloading the contents at a remote location. Baskets that are formed as part of the inner liner can be awkward to load. In addition, when the door is simultaneously supporting a rack, the basket is not readily accessible. Baskets that are removably mounted to the door typically do not clean flatware as well as rack mounted baskets, with this drawback being attributed to the designs employed in the prior art. In any event, while both designs possess certain advantages, both designs also have their respective drawbacks.

Therefore, despite the existence of utensil baskets in the prior art, there still exists a need for a utensil basket incorporating a flexible mounting arrangement for use in a dishwasher. More specifically, there exists a need for a utensil basket that can be selectively supported on either a door or a rack.

SUMMARY OF THE INVENTION

The present invention is directed to a utensil holder assembly for use in a dishwasher. The dishwasher includes a wash chamber, a door for selectively sealing the wash chamber and at least one rack. The door includes an outer, decorative shell and an inner liner. In accordance with the invention, the utensil holder assembly includes multiple utensil baskets that can be mounted in various different configurations in the dishwasher. The various configurations provide a consumer with the flexibility to construct diverse arrangements of dishware, cookware, utensils and the like to provide maximum exposure to a washing fluid spray.

More specifically, the utensil holder assembly includes a first basket having front, back, bottom and opposing side walls, and a second, similarly constructed, basket. In accordance with a preferred embodiment of the invention, one of the side walls of the first basket is provided with a mounting member and one of the side walls of the second basket is provided with a mounting element. The mounting member on the first basket is designed to mate with the mounting element on the second basket. In this manner, the first and second baskets can be interconnected to form an elongated basket that can be mounted in a first configuration. When in the first configuration, the elongated basket can be selectively mounted to the inner liner of the door or placed in the rack. In a second configuration, the first and second baskets are separated, with one basket being mounted to the inner liner and the other basket placed on the rack. Finally, in a third configuration, the first and second baskets can be separately mounted in the rack.

In further accordance with the invention, at least one of the first and second baskets includes a pivotal front wall. More specifically, the front wall includes a pair of opposing pin members that engage with the opposing side walls to define a horizontal pivot axis. With this arrangement, the front wall can be moved from a closed position to an open position to facilitate the removal of utensils at the completion of a wash operation. In addition, the front wall is provided with tab elements that retain the front wall in the closed position. Preferably, the tab elements project into openings provided on surfaces that extend inward from each side wall. Most preferably, the tab elements engage with a handle that extends between the front and back walls at each of the opposing side walls.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
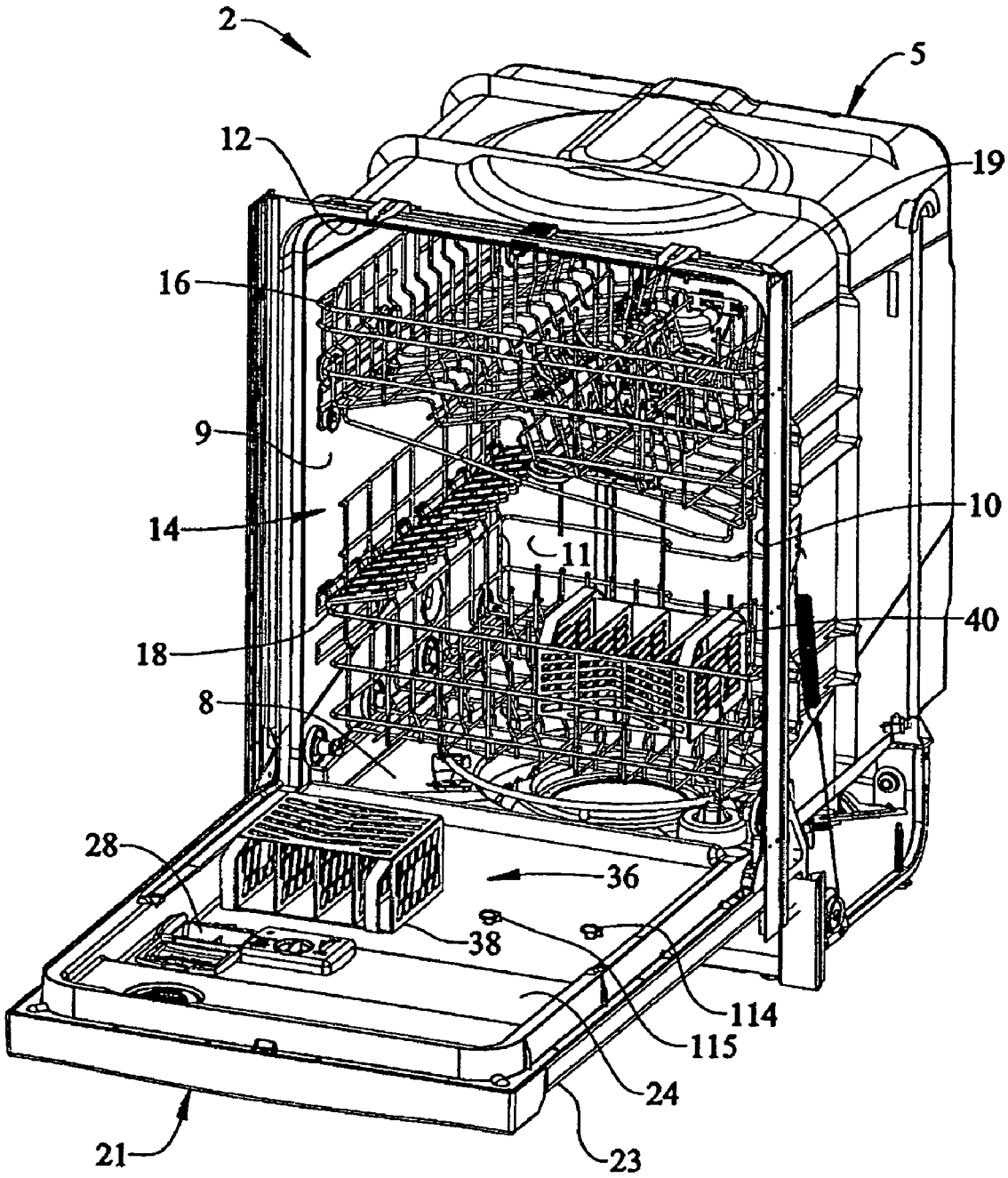
FIG. 1 is an upper right perspective view of a dishwasher illustrating a utensil holder assembly having a first utensil basket mounted to a door of the dishwasher and a second utensil basket supported upon a dish rack.

With initial reference to FIG. 1, a dishwasher constructed in accordance with the present invention is generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks 16 and 18, with the kitchenware being cleaned during a washing operation in a manner widely known in the art.

Tub 5 has attached thereto a frontal frame 19 which pivotally supports a door 21 used to seal chamber 14 during the washing operation. In a manner known in the art, door 21 includes an outer, decorative panel 23 and an inner liner 24. In the embodiment shown, door 21 is preferably provided with a detergent tray assembly 28 that is mounted to inner liner 24. In connection with the washing operation, a consumer can place liquid or particulate washing detergent in detergent tray assembly 28 for dispensing at predetermined portions of the washing operation. In general, the structure described above is known in the art and is only being described for the sake of completeness. Instead, the present invention is particularly directed to a utensil holder assembly 36 having first and second utensil baskets 38 and 40.

Figure 2:
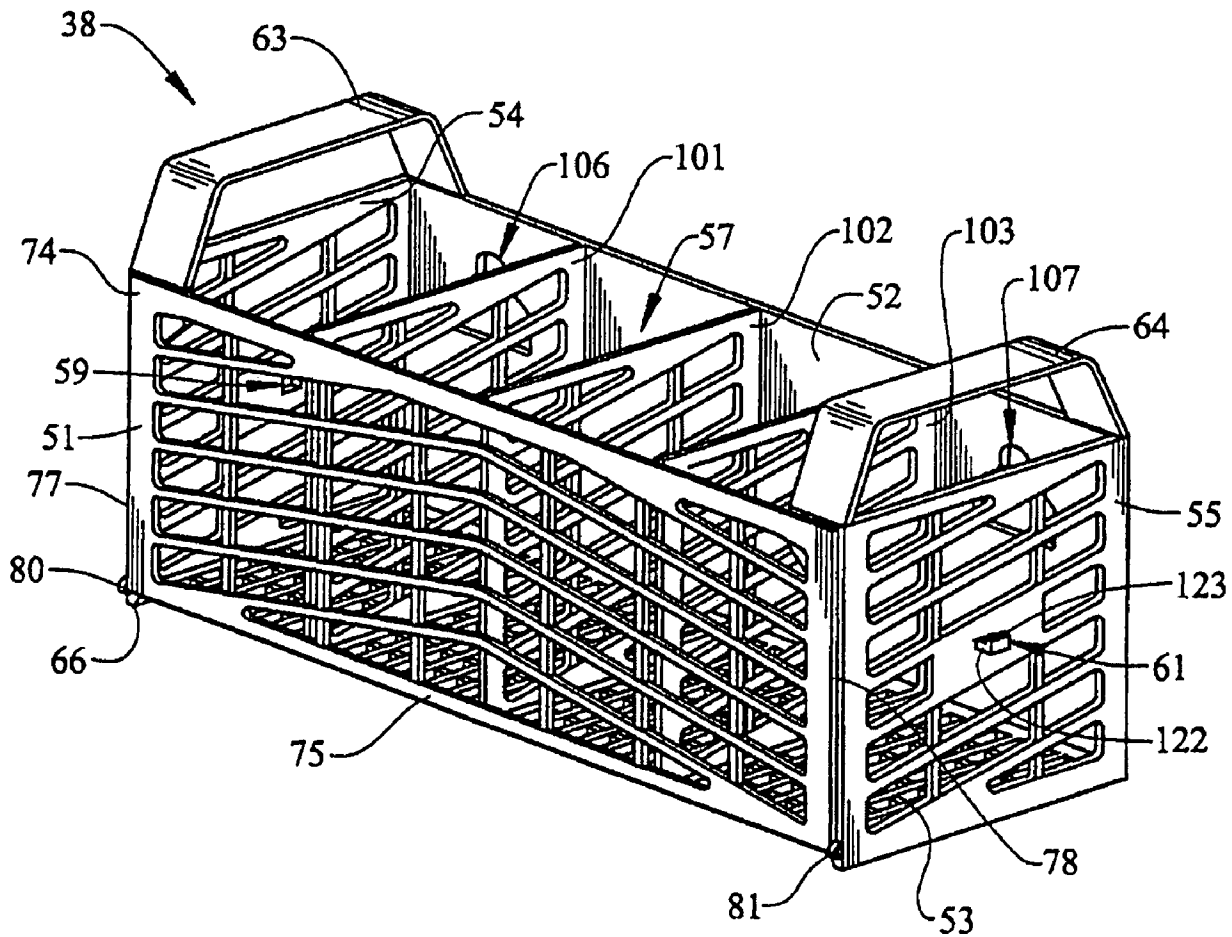
FIG. 2 is an upper right perspective view of the first utensil basket of FIG. 1 illustrated with a front wall of the basket in a closed position.
Figure 3:
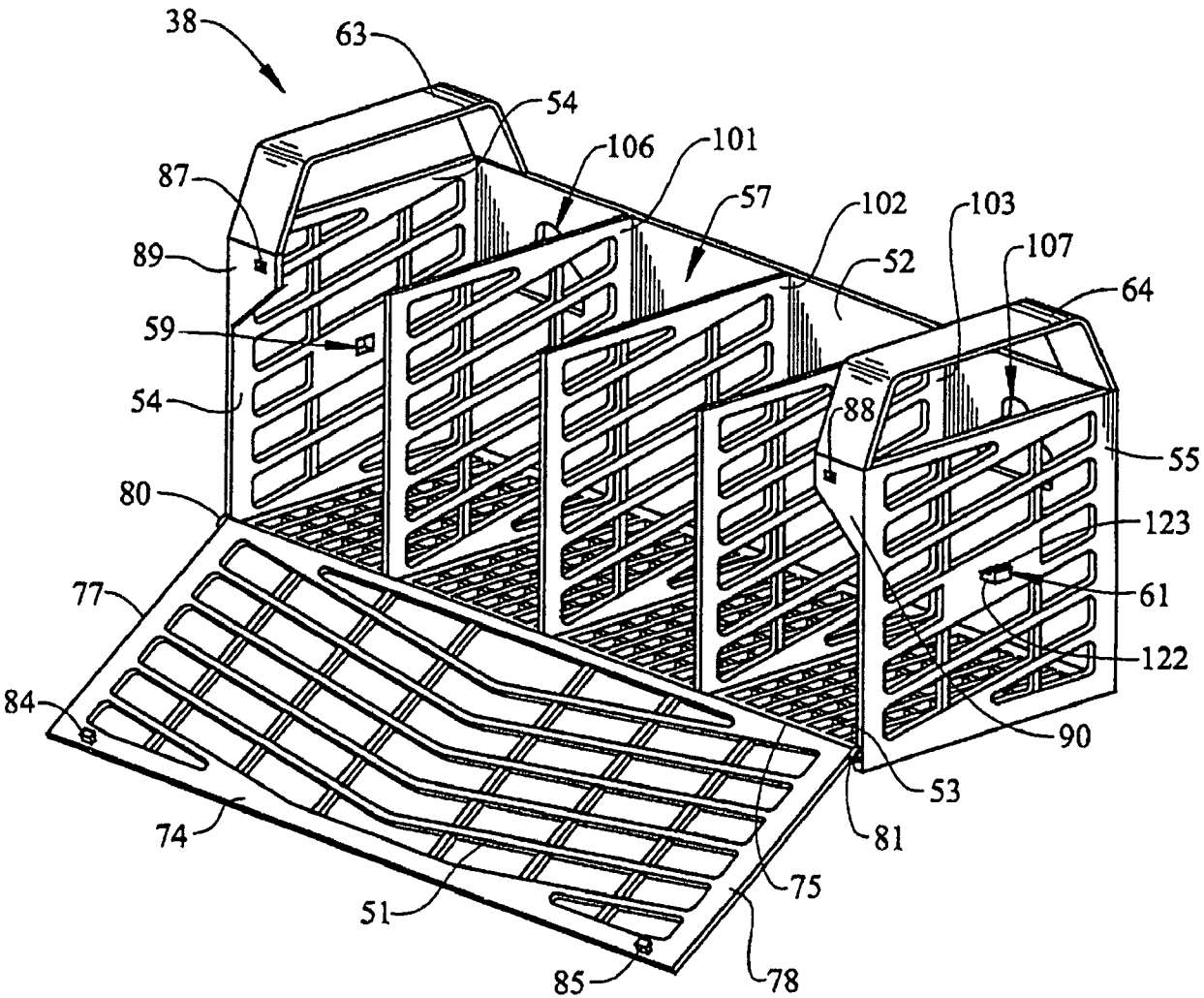
FIG. 3 is an upper right perspective view of the utensil basket of FIG. 2 illustrated with the front wall of the basket in an open position.
Figure 5:
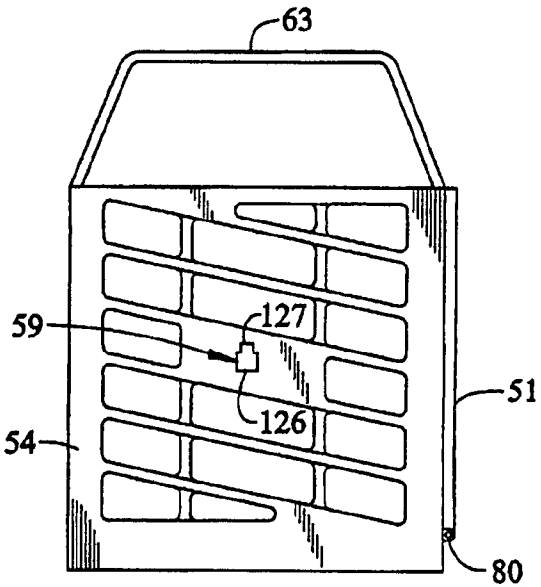
FIG. 5 is a right side elevational view of the utensil basket of FIG. 2.
Figure 4:
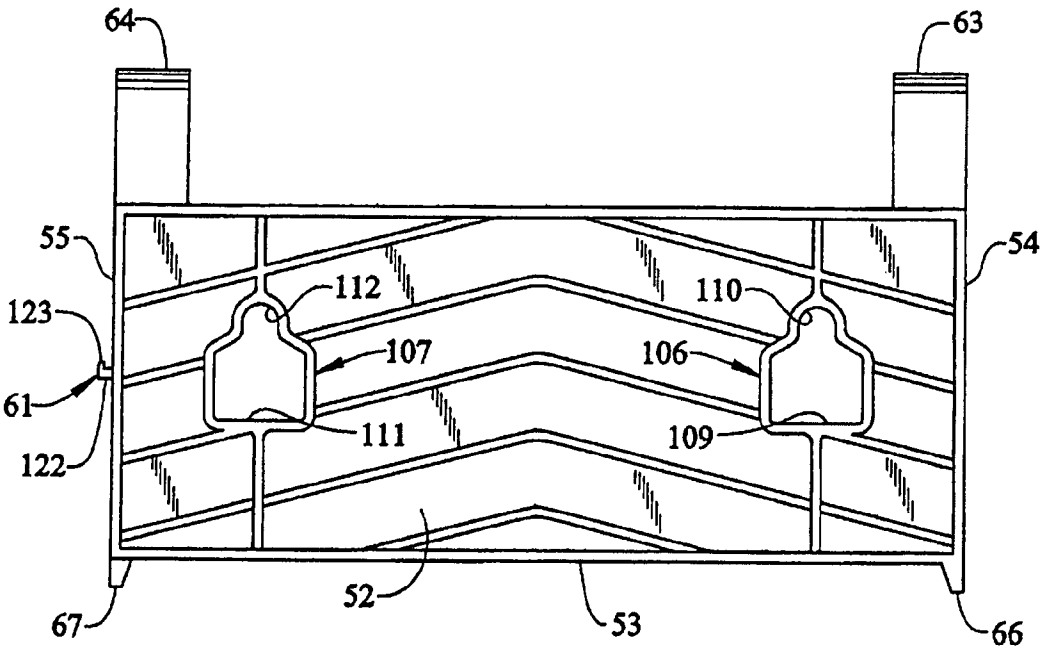
FIG. 4 is a rear elevational view of the utensil basket of FIG. 2.

Reference will now be made to FIGS. 2-5 in describing a preferred construction of utensil holder assembly 36. However, as each utensil basket 38 and 40 is identical, a detailed description will be made with respect to first utensil basket 38, with an understanding that second utensil basket 40 has corresponding structure. As shown, utensil basket 38 includes front, back, bottom and side walls 51-55 that collectively define a storage compartment 57. Preferably, front wall 51, bottom wall 53 and side walls 54 and 55 are constructed from plastic having an open lattice work that enables the washing fluid to impact utensils stored therein. In accordance with the invention, side wall 54 includes a mounting element 59 (FIG. 3). Similarly, side wall 55 is provided with a mounting member 61 which, as will be discussed more fully below, is designed to engage with a corresponding mounting element (not shown) on second utensil basket 40. In accordance with one aspect of the invention, mounting member 61 is adapted to snap-fit into the mounting element. Additionally, first utensil basket 38 is provided with a pair of handles 63 and 64 that extend between back wall 52 and front wall 51, as well as a plurality of feet members 66 and 67 (FIG. 4). Feet members 66 and 67 are provided to support basket 38 when basket 38 is placed upon, for example, a kitchen counter top (not shown) or the like.

In further accordance with the present invention, front wall 51 of utensil basket 38 is pivotable about a generally horizontal axis. More specifically, front wall 51 includes vertically spaced top and bottom edge portions 74 and 75, as well as laterally spaced side edge portions 77 and 78. In the embodiment shown, a pair of hinge elements 80 and 81 are arranged at lower corner portions (not separately labeled) formed by the intersection of bottom edge portion 75 with vertically spaced side edge portions 77 and 78. Hinge elements 80 and 81 allow front wall 51 to pivot between a first or closed position, as represented in FIG. 2, to a second or open position, as represented in FIG. 3. In order to retain front wall 51 in the closed position, a pair of clip elements 84 and 85 are provided on top edge 74. Clip elements 84 and 85 are adapted to engage with corresponding clip receivers 87 and 88 provided on respective surface portions 89 and 90 that project inward from a top portion (not separately labeled) of side walls 54 and 55 respectively. Actually, in the most preferred form of the invention, surface portions 89 and 90 constitute front end portions of handles 63 and 64.

As shown, utensil basket 38 is provided with a plurality of dividers 101-103 that separate storage compartment 57 into a plurality of smaller compartments (not separately labeled). Preferably, dividers 101-103 are integrally formed with and fixedly secured to both back wall 52 and bottom wall 53. Back wall 52 is also provided with a pair of mounting slots 106 and 107 which, as will be discussed more fully below, are adapted to secure basket 38 to inner liner 24. As best shown in FIG. 4, mounting slot 106 includes a lower portion 109 that narrows to a smaller upper portion 110. Likewise, mounting slot 107 includes corresponding lower and upper portions 111 and 112. With this arrangement, basket 38 can be detachably mounted to inner liner 24 upon posts, such as shown at 114-117 in FIGS. 1 and 7. More specifically, each post 114-117 includes a first or narrow section (not separately labeled) and a broader, second portion (also not separately labeled). With this arrangement, utensil basket 38 can be mounted to inner liner 24 with lower portions 109 and 111 receiving the broader second portions of, for example, posts 114 and 115. At this point, basket 38 is shifted relative to posts 14 and 115 until the narrow sections of posts 114 and 115 slide into smaller upper portion 110. In this manner, once in position, basket 38 will not inadvertently fall or be knocked off of inner liner 24 when door 21 is transitioned between its open and closed positions or during a washing operation.

Figure 6:
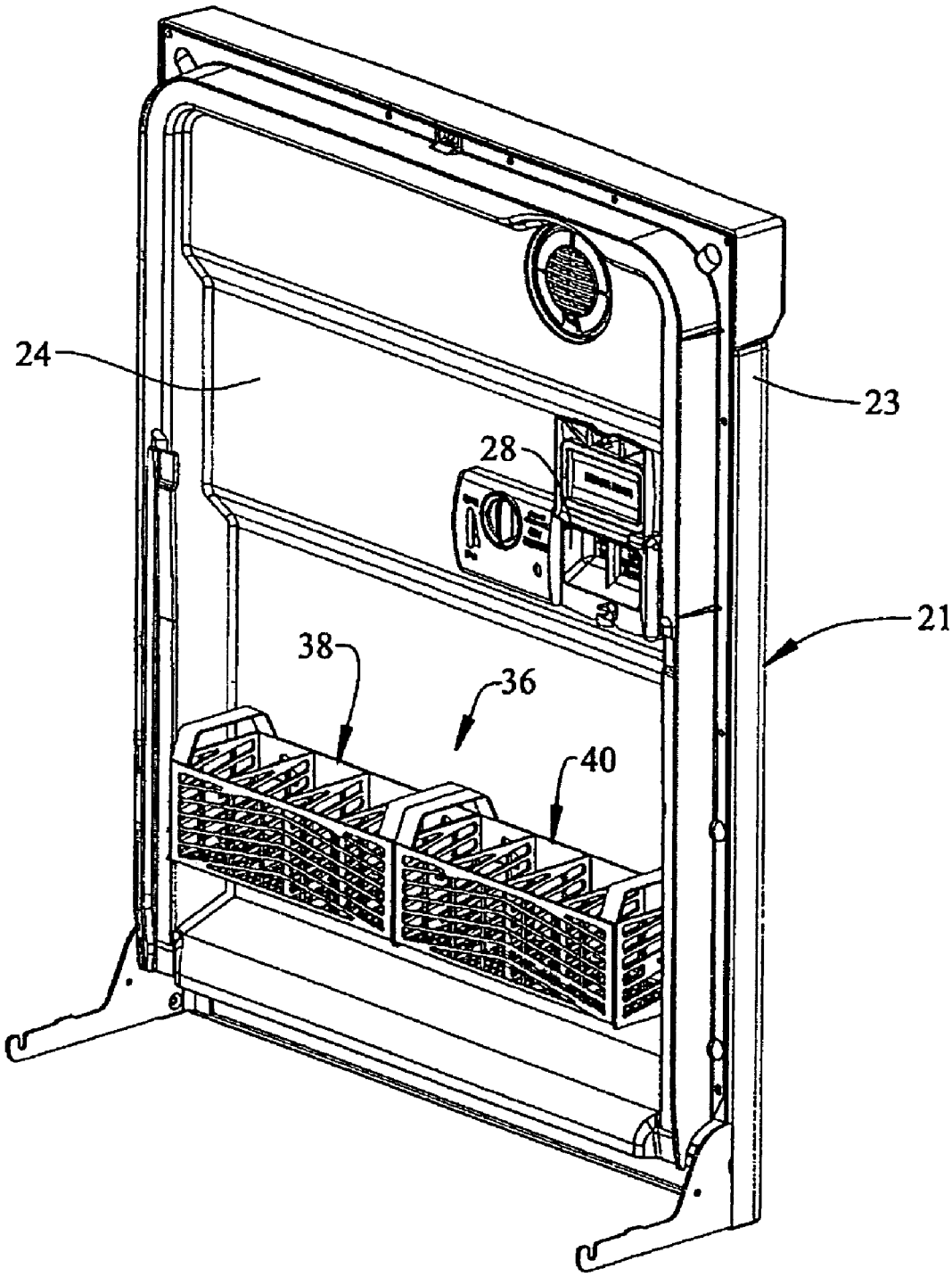
FIG. 6 is an upper right perspective view of the utensil holder assembly mounted in a first configuration, with the first and second utensil baskets being interconnected and mounted on the door.

In accordance with the most preferred form of the present invention, utensil holder assembly 36 can be positioned within dishwasher 2 in a variety of different configurations. Specifically, in a first configuration as represented in FIG. 6, first utensil basket 38 is interconnected to second utensil basket 40 to form a single elongated utensil holder assembly 36. More specifically, first and second utensil baskets 38 and 40 are interconnected by joining, for example, mounting member 61 on basket 38 with mounting element 59 on basket 40. Toward that end, mounting member 61 is provided with a post 122 which projects substantially perpendicularly from side wall 55 and terminates in a hook element 123 as best shown in FIG. 4. In a manner similar to that described above with respect to mounting slots 106 and 107, mounting element 59 is provided with a first or lower portion 126 and a narrowed second or upper portion 127 (see FIG. 5). Lower portion 126 is adapted to receive hook element 123 and relative sliding between first and second utensil baskets 38 and 40 will cause post 122 to extend upper portion 127 in order to establish a releasable connection.

Figure 7:
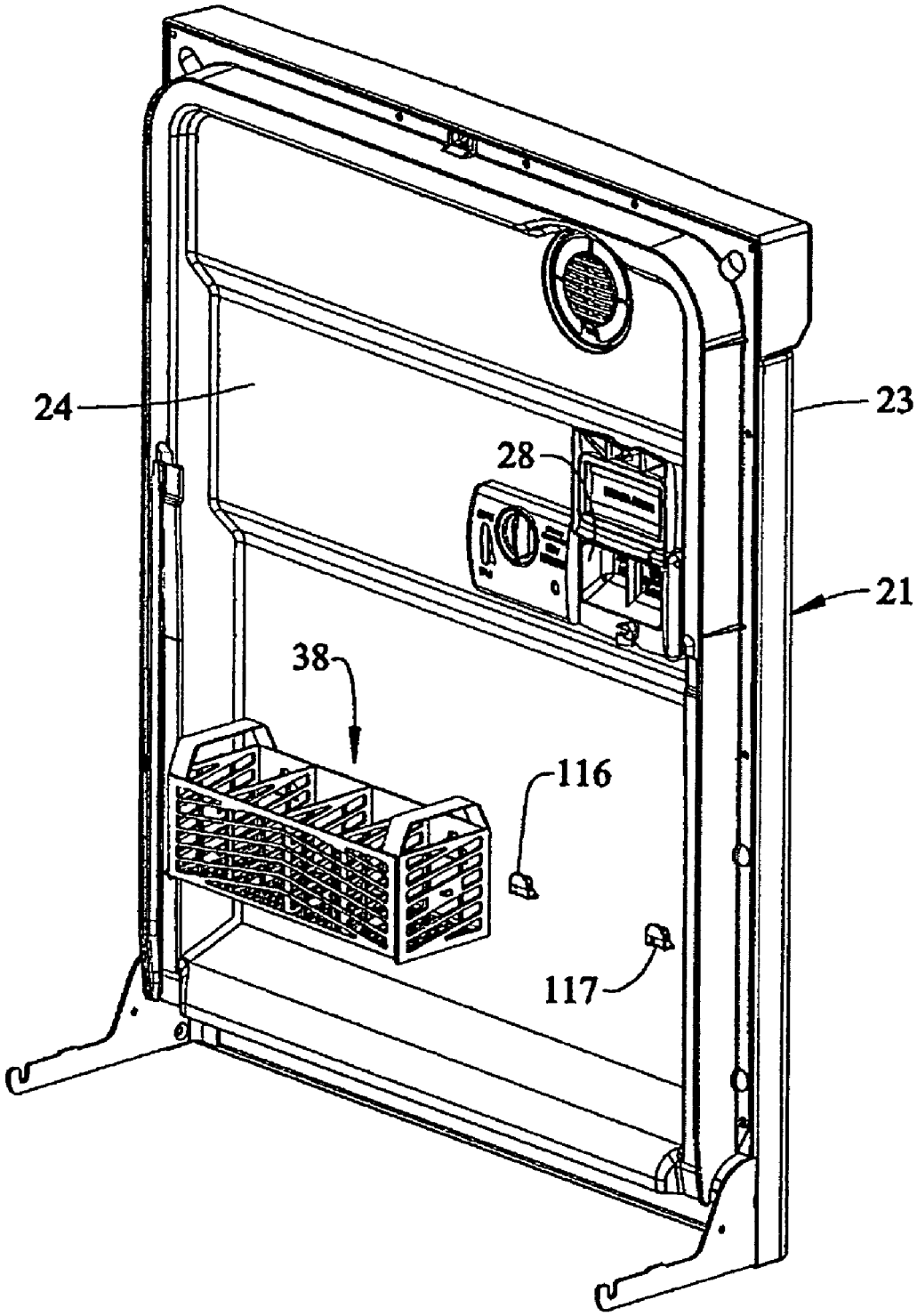
FIG. 7 is an upper right perspective view of the utensil holder assembly constructed in accordance with the present invention shown in a second configuration with a single utensil basket mounted to the door.

In addition to the configuration illustrated in FIG. 6, utensil holder assembly 36 can be mounted in a second configuration as represented in FIG. 7. As shown, utensil holder assembly 36 is separated into individual utensil baskets 38 and 40 with basket 38 shown mounted in a side zone on inner liner 24. More specifically, basket 38 is mounted to posts 114 and 115 on inner liner 24. Alternatively, basket 38 could be mounted in an opposing side zone through posts 116 and 117 or mounted in a central position on posts 115 and 116. Additionally, while not shown, utensil basket 40 can be positioned on one of upper and lower racks 16 and 18 or, for that matter, left out of dishwasher 2 completely. Finally, in a third configuration, instead of mounting to inner liner 24, utensil basket assembly 36 could be placed on upper and lower racks 16 and 18, or separated such that utensil baskets 38 and 40 can be mounted individually upon upper and lower racks 16 and 18. The particular configuration employed is based solely upon individual needs.

Based on the above, it should be understood that the utensil holder assembly of the present invention enables a consumer to vary the mounting locations of utensil baskets 38 and 40 in dishwasher 2 depending upon the particular load of dishware. Therefore, in the event that additional rack space is needed, utensil holder assembly 36 can be mounted either as an individual basket on inner liner 24, interconnected to form an elongated basket that is mounted upon inner liner 24, or simply placed as individual units or joined to form an elongated basket and placed upon one of racks 16 and 18.

Although described with reference to a preferred embodiment of the present invention, it should be readily apparent to one of ordinary skill in the art that various changes and/or modifications can be made to the invention without departing from the spirit thereof. For instance, while baskets 38 and 40 are shown having a generally rectangular shape, other geometries that would allow side walls to be interconnected would also be acceptable. In addition, a single basket 38 could be mounted in a center zone. Finally, other arrangements for interconnection utensil baskets 38 and 40 together or to inner liner 24 could be employed. In general, the invention is only intended to be limited by the scope of the following claims.

We claim:

1. A dishwasher comprising:

a tub having top, bottom, rear and opposing side walls that collectively define a wash chamber having a frontal opening;

a door for selectively closing the frontal opening, said door including an outer shell and an inner liner:

at least one rack received in the wash chamber; and a utensil holder assembly including a first basket having front, back, bottom and opposing side walls and a second basket having front, back, bottom and opposing side walls, one of said side walls of the first basket being provided with a mounting element and one of said side walls of the second basket being provided with a mounting member, said mounting element being adapted to join with the mounting member to interconnect the first and second baskets wherein, said utensil holder assembly can be selectively positioned in a first configuration, wherein said mounting member is joined with said mounting element to interconnect the first and second baskets which are both, individually detachably mounted to the inner liner of the door and, in a second configuration, wherein either one of said first and second baskets is detachably mounted to the inner liner of the door and another of the first and second baskets is supported by the at least one rack.

2. The dishwasher according to claim 1, wherein the utensil holder assembly can be positioned in a third configuration wherein both of the first and second baskets are supported in the at least one rack.

3. The dishwasher according to claim 1, wherein the front wall of at least one of the first and second baskets pivots about a substantially horizontal axis.

4. The dishwasher according to claim 3, wherein the at least one of the first and second baskets includes a hinge element located at a lower front portion of the opposing side walls, said hinge element defining an axis of rotation for the front wall.

5. The dishwasher according to claim 4, wherein the front wall of the at least one of the first and second baskets includes a top edge portion, said top edge portion being provided with a clip element that secures the front wall to the basket.

6. The dishwasher according to claim 5, wherein the first basket includes first and second handles, each of said first and second handles extending between the front and back wall at the opposing side walls of the first basket.

7. The dishwasher according to claim 6, wherein a portion of at least one of the first and second handles at the front wall includes a clip receiver, said clip receiver being adapted to receive the clip element member of the front wall to retain the front wall in the closed position.

8. The dishwasher according to claim 1, wherein the mounting member constitutes a post extending from one of the side walls.

9. The dishwasher according to claim 8, wherein the mounting element includes a lower portion and a narrow, upper portion, said mounting element being adapted to receive the post to interconnect the first and second baskets.

10. The dishwasher according to claim 9, wherein the post is adapted to snap-fit into the mounting element.

11. The dishwasher according to claim 9, wherein the post is adapted to extend into the lower portion of the mounting element and thereafter the first basket is interconnected to the second basket through a sliding engagement of the post into the narrow, upper portion of the mounting element.

12. The dishwasher according to claim 11, wherein the post terminates in a hook element, said hook element being adapted to engage with the side wall of the basket through the narrow, upper portion of a slot to detachably interconnect the first and second baskets.

13. The dishwasher according to claim 1, further comprising: a plurality of posts projecting substantially from the inner liner of the door, each of said posts terminating in a hook member, said hook member being adapted to detachably retain one of an elongated basket or the first and second baskets to the inner liner of the door.

14. The dishwasher according to claim 13, wherein the posts define mounting zones on the inner liner of the door.

15. The dishwasher according to claim 14, wherein the back wall of at least one of the first and second baskets includes a plurality of mounting slots, said mounting slots adapted to support the at least one basket in one of the mounting zones.

16. A dishwasher comprising:

a tub having top, bottom, rear and opposing side walls that collectively define a wash chamber having a frontal opening;

a door for selectively sealing the frontal opening, said door including an outer shell and an inner liner;

a rack slidably received in the wash chamber;

a utensil holder assembly including a first basket having front, back, bottom and opposing side walls and a second basket having front, back, bottom and opposing side walls;

means for mounting the utensil holder assembly in a plurality of configurations in the dishwasher wherein, in a first configuration the first and second baskets are both, individually detachably secured to the inner liner of the door and, in a second configuration, either one of the first and second baskets is detachably mounted to the inner liner and another one of the first and second baskets is supported upon the rack.

17. The dishwasher according to claim 16, wherein the mounting means includes a third configuration wherein the first and second baskets are individually supported upon the rack.

* * * * *

UNITED STATES PATENT AND TRADEMARK OFFICE

CERTIFICATE OF CORRECTION

PATENT NO. : 8,168,006 B2
APPLICATION NO. : 11/114177
DATED : May 1, 2012
INVENTOR(S) : Debra L. Bengston et al.

It is certified that error appears in the above-identified patent and that said Letters Patent is hereby corrected as shown below:

Col. 5, line 27 - 51, Claim 1: "A dishwasher comprising: a tub having top, bottom, rear and opposing side walls that collectively define a wash chamber having a frontal opening; a door for selectively closing the frontal opening, said door including an outer shell and an inner liner: at least one rack received in the wash chamber; and a utensil holder assembly including a first basket having front, back, bottom and opposing side walls and a second basket having front, back, bottom and opposing side walls, one of said side walls of the first basket being provided with a mounting element and one of said side walls of the second basket being provided with a mounting member, said mounting element being adapted to join with the mounting member to interconnect the first and second baskets wherein, said utensil holder assembly can be selectively positioned in a first configuration, wherein said mounting member is joined with said mounting element to interconnect the first and second baskets which are both, individually detachably mounted to the inner liner of the door and, in a second configuration, wherein either one of said first and second baskets is detachably mounted to the inner liner of the door and another of the first and second baskets is supported by the at least one rack." - should be Claim 1: --A dishwasher comprising: a tub having top, bottom, rear and opposing side walls that collectively define a wash chamber having a frontal opening; a door for selectively closing the frontal opening, said door including an outer shell and an inner liner; at least one rack received in the wash chamber; and a utensil holder assembly including a first basket having front, back, bottom and opposing side walls and a second basket having front, back, bottom and opposing side walls, one of said side walls of the first basket being provided with a mounting element and one of said side walls of the second basket being provided with a mounting member, said mounting element being adapted to join with the mounting member to interconnect the first and second baskets wherein, said utensil holder assembly can be selectively positioned in a first configuration, wherein said mounting member is joined with said mounting element to interconnect the first and second baskets which are both, individually detachably mounted to the inner liner of the door and, in a second configuration, wherein either one of said first and second baskets is detachably mounted to the inner liner of the door and another of the first and second baskets is supported by the at least one rack.--

Signed and Sealed this
Fourteenth Day of August, 2012

David J. Kappos

David J. Kappos
*Director of the United States Patent and Trademark Office*